US012247559B2

(12) United States Patent
Tanaka

(10) Patent No.: US 12,247,559 B2
(45) Date of Patent: Mar. 11, 2025

(54) FLUID CONTROL DEVICE

(71) Applicant: Murata Manufacturing Co., Ltd., Kyoto (JP)

(72) Inventor: Nobuhira Tanaka, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 40 days.

(21) Appl. No.: 18/154,251

(22) Filed: Jan. 13, 2023

(65) Prior Publication Data

US 2023/0140980 A1 May 11, 2023

Related U.S. Application Data

(63) Continuation of application No. PCT/JP2021/016807, filed on Apr. 27, 2021.

(30) Foreign Application Priority Data

Jul. 17, 2020 (JP) ..... 2020-122530
Dec. 18, 2020 (JP) ..... 2020-209762

(51) Int. Cl.
*F04B 43/04* (2006.01)

(52) U.S. Cl.
CPC ..... *F04B 43/046* (2013.01)

(58) Field of Classification Search
CPC ..... F04B 17/003; F04B 43/04; F04B 43/043; F04B 43/046; F04B 45/045; F04B 45/047; F04B 53/1065; F04B 53/123
See application file for complete search history.

(56) References Cited

U.S. PATENT DOCUMENTS 6,116,866 A 9/2000 Tomita et al.
2003/0152469 A1* 8/2003 Dante ..... F04B 43/046 417/478
2005/0089415 A1* 4/2005 Cho ..... F04B 45/047 417/413.1

(Continued)

FOREIGN PATENT DOCUMENTS

CN 115210469 A * 10/2022 ..... F04B 43/043
EP 0435653 A1 * 7/1991

(Continued)

OTHER PUBLICATIONS

International Search Report for PCT/JP2021/016807 dated Jul. 6, 2021.

*Primary Examiner* — Alexander B Comley
(74) *Attorney, Agent, or Firm* — McDonald Hopkins LLC

(57) ABSTRACT

A fluid control device includes: a first flat plate; a frame disposed outside an outer peripheral end of the first flat plate via openings; a connection member connecting the first flat plate and the frame; a plate member having through holes in a portion facing the first flat plate; and a valve member configured to rectify a fluid flow. An outer end of the valve member projects toward an outside of the outer peripheral end of the first flat plate. A portion of the valve member closer to an inner end thereof located closer to a center of the first flat plate is fixed to the first flat plate. The outer end of the valve member is not fixed. The valve member has a first portion closer to the outer end, and a second portion closer to an inner end of the first portion.

18 Claims, 9 Drawing Sheets

(56) References Cited

U.S. PATENT DOCUMENTS

| | | | | |
|---|---|---|---|---|
| 2006/0027772 | A1* | 2/2006 | Richter | F16K 99/0007 251/129.06 |
| 2013/0055889 | A1* | 3/2013 | Herz | F16K 99/0001 92/96 |
| 2013/0071273 | A1* | 3/2013 | Locke | F04B 45/045 417/480 |
| 2017/0218939 | A1* | 8/2017 | Chen | F04B 39/1066 |
| 2018/0066650 | A1* | 3/2018 | Fujisaki | F04B 43/023 |
| 2019/0038145 | A1* | 2/2019 | Kawamura | A61B 5/0235 |
| 2019/0056368 | A1* | 2/2019 | Mou | G08B 21/12 |
| 2019/0170133 | A1* | 6/2019 | Tanaka | F16K 99/0015 |
| 2020/0224650 | A1* | 7/2020 | Tanaka | F04B 45/045 |
| 2020/0370544 | A1* | 11/2020 | Tanaka | A61M 1/962 |
| 2021/0048013 | A1 | 2/2021 | Tanaka et al. | |
| 2022/0074401 | A1* | 3/2022 | Tanaka | F04B 43/0054 |

FOREIGN PATENT DOCUMENTS

| | | | | | |
|---|---|---|---|---|---|
| JP | H05172060 | A | * | 7/1993 | |
| JP | H10-213077 | A | | 8/1998 | |
| JP | 2009185800 | A | * | 8/2009 | F04B 43/043 |
| JP | 2009-299871 | A | | 12/2009 | |
| JP | 2017072140 | A | * | 4/2017 | |
| JP | 2017-133508 | A | | 8/2017 | |
| JP | 6536770 | B | | 7/2019 | |
| JP | 6536770 | B1 | * | 7/2019 | F04B 17/003 |
| JP | 2019190343 | A | * | 10/2019 | |
| WO | WO-2016121717 | A1 | * | 8/2016 | F04B 45/047 |
| WO | WO2016013390 | A1 | * | 4/2017 | |
| WO | WO-2019138675 | A1 | * | 7/2019 | F04B 43/04 |
| WO | 2019/159448 | A1 | | 8/2019 | |
| WO | 2019/221121 | A1 | | 11/2019 | |
| WO | 2019/230159 | A1 | | 12/2019 | |
| WO | WO-2019230161 | A1 | * | 12/2019 | F04B 43/04 |
| WO | WO-2020111063 | A1 | * | 6/2020 | F04B 43/0054 |

* cited by examiner

FLUID CONTROL DEVICE

CROSS REFERENCE TO RELATED APPLICATION

This is a continuation of International Application No. PCT/JP2021/016807 filed on Apr. 27, 2021 which claims priority from Japanese Patent Application No. 2020-122530 filed on Jul. 17, 2020 and Japanese Patent Application No. 2020-209762 filed on Dec. 18, 2020. The contents of these applications are incorporated herein by reference in their entireties.

BACKGROUND OF THE DISCLOSURE

Field of the Disclosure

The present disclosure relates to a fluid control device configured to convey a fluid in one direction.

Description of the Related Art

Patent Document 1 describes a fluid control device including a pump and a valve that are integrally formed with each other. The pump has a pump chamber having one surface formed by a vibration plate. The valve has a valve chamber communicating with the pump chamber.

A valve membrane is disposed in the valve chamber. A fluid flow causes the valve membrane to move in the valve chamber, thus rectifying the fluid flow.

Patent Document 1: Japanese Patent No. 6536770

BRIEF SUMMARY OF THE DISCLOSURE

Conceivable examples of a configuration in which a valve membrane is used as in the fluid control device described in Patent Document 1 include one in which a valve membrane is disposed in a pump chamber. In this case, the valve membrane parallel to a direction in which a fluid flows has one end and the other end, the one end being fixed to an inner wall of a pump, the other end being movable. When the fluid flows in a certain direction, the other end of the valve membrane moves toward a wall surface to which the valve membrane is fixed, and the fluid is conveyed. On the other hand, when the fluid tries to flow in the opposite direction, the other end of the valve membrane moves toward a wall surface facing the wall surface to which the valve membrane is fixed and comes into contact with this wall surface. Thus, the fluid flow is obstructed. Accordingly, the fluid flow is rectified.

However, in such a configuration in which a valve membrane is disposed in a pump chamber, a portion close to the other end of the valve membrane may come into contact with a corner of an outer peripheral end of a wall forming the pump chamber. Such contact causes a problem of wearing and damaging the valve membrane.

Accordingly, a possible benefit of the present disclosure is to provide a fluid control device capable of inhibiting a valve membrane from being worn and damaged.

A fluid control device of the present disclosure includes: a first flat plate having a first opening outside an outer peripheral end of the first flat plate; a frame disposed outside the outer peripheral end of the first flat plate; a connection member connecting the first flat plate and the frame; a second flat plate having a second opening in a portion facing the first flat plate, the second flat plate facing the first flat plate, the frame, and the connection member; a side wall member connecting the frame and the second flat plate, the side wall member forming a hollow chamber including a region that the first flat plate and the second flat plate face; a driver attached to the first flat plate; and a valve member set on a first surface, closer to a pump chamber, of the first flat plate, the valve member being configured to rectify a fluid flow.

An outer end of the valve member located closer to the outer peripheral end of the first flat plate projects toward an outside of the outer peripheral end. A portion of the valve member closer to an inner end thereof located closer to a center of the first flat plate is fixed to the first flat plate. The outer end of the valve member is not fixed. The valve member has a first portion forming a portion closer to the outer end, the first portion having a first thickness, and a second portion forming a portion closer to an inner end of the first portion, the second portion having a second thickness. The second thickness is larger than the first thickness. The second portion overlaps the outer peripheral end.

With this configuration, even when the valve member bends toward the first flat plate, the second portion comes into contact with a corner of the first flat plate. Since the second portion is thicker than the first portion, the valve member is less prone to being worn and damaged compared with the case in which the first portion comes into contact with the corner of the first flat plate. In addition, the thickness of the first portion is small, thus inhibiting deterioration of a rectifying function required for the valve member.

The present disclosure is capable of inhibiting a valve membrane from being worn and damaged.

DETAILED DESCRIPTION OF THE DISCLOSURE

Embodiment 1

Figure 1:
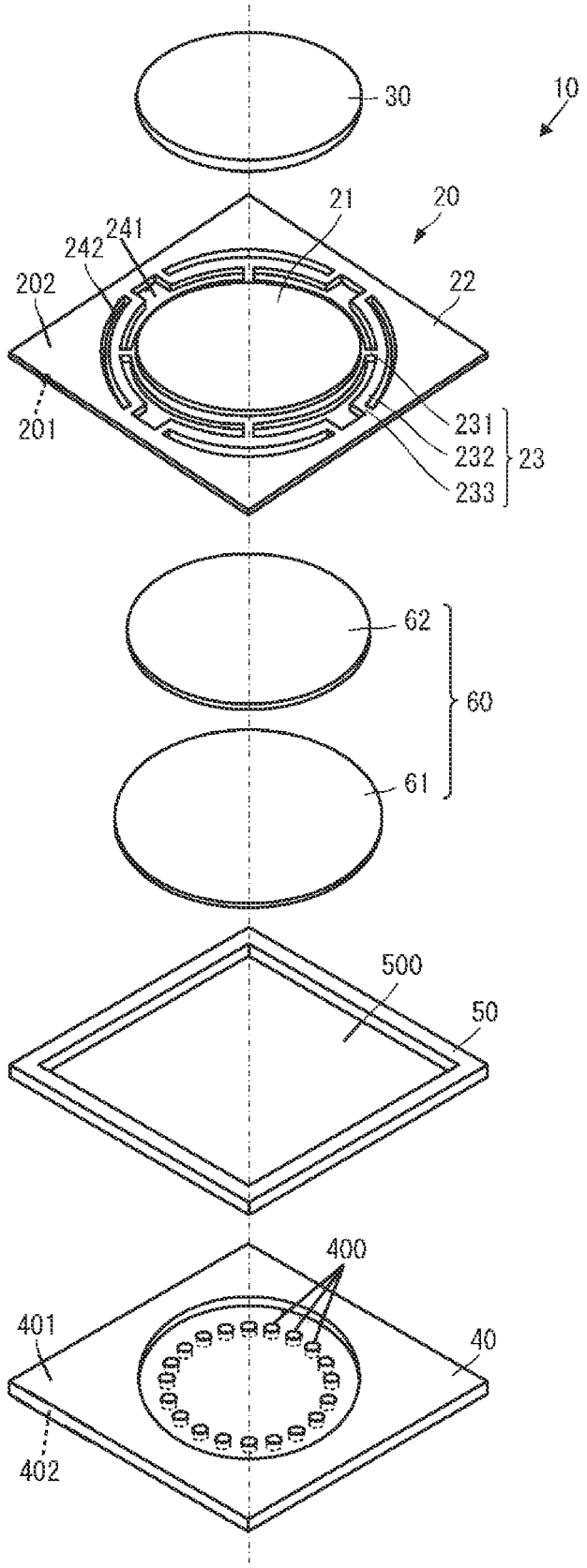
FIG. 1 is an exploded perspective view of a fluid control device according to Embodiment 1.
Figure 2:
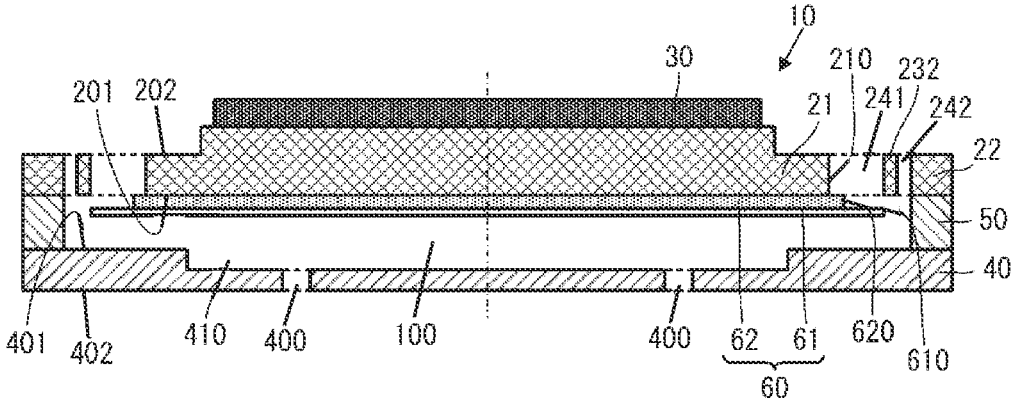
FIG. 2 is a side sectional view illustrating the configuration of the fluid control device according to Embodiment 1.
Figure 3:
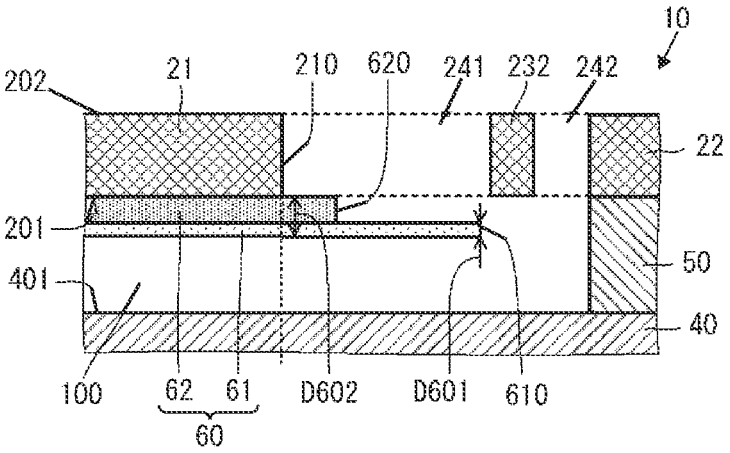
FIG. 3 is an enlarged view of a region including an outer peripheral end of a first flat plate of the fluid control device according to Embodiment 1.

A fluid control device according to Embodiment 1 of the present disclosure will be described with reference to the drawings. FIG. 1 is an exploded perspective view of the fluid control device according to Embodiment 1. FIG. 2 is a side sectional view illustrating the configuration of the fluid control device according to Embodiment 1. FIG. 3 is an enlarged view of a region including an outer peripheral end of a first flat plate of the fluid control device according to Embodiment 1. In the respective drawings of the embodiments including the present embodiment, the entire or partial shapes of the respective components are illustrated in an exaggerated manner as appropriate to make the configuration of the fluid control device easy to understand. In the following embodiments, a view when a component having a main surface is viewed in a direction orthogonal to the main surface is referred to as plan view.

As illustrated in FIGS. 1, 2, and 3, a fluid control device 10 includes a plate member 20, a driver 30, a plate member 40, a side wall member 50, and a valve member 60.

Configuration of Plate Member 20

The plate member 20 is made of, for example, a metal plate and has a main surface 201 and a main surface 202. The plate member 20 includes a first flat plate 21, a frame 22, and a plurality of connection members 23. For example, the first flat plate 21, the frame 22, and the plurality of connection members 23 are integrally formed by one flat plate.

The first flat plate 21 has a plate-like shape. The first flat plate 21 has an outer peripheral portion including an outer peripheral end 210, and a central portion located closer to the center thereof than the outer peripheral portion. The central portion is thicker than the outer peripheral portion. The shape of the first flat plate 21 in plan view (shape viewed in the thickness direction) is a circular shape. In the first flat plate 21, the central portion projects at the main surface 202. Conversely, in the first flat plate 21, the central portion and the outer peripheral portion including the outer peripheral end form a plane at the main surface 201.

The frame 22 is a flat plate. The shape of the frame 22 in plan view is a square. The frame 22 has an opening. The opening passes through the flat plate forming the frame 22 in the thickness direction. The opening has a circular shape in plan view. The shape of the opening is similar to the outer peripheral shape of the first flat plate 21 and is larger than the outer peripheral shape of the first flat plate 21. The center of the frame 22 and the center of the opening coincide with each other.

The first flat plate 21 is disposed in the opening of the frame 22. In this case, the center of the opening and the center of the first flat plate 21 coincide with each other. The area of the first flat plate 21 is smaller than the area of the opening of the frame 22. Thus, even when the first flat plate 21 is disposed in the opening of the frame 22, an opening remains between the outer peripheral end of the first flat plate 21 and the frame 22.

The plurality of connection members 23 each have a beam shape. The plurality of connection members 23 are disposed in the opening between the first flat plate 21 and the frame 22. The plurality of connection members 23 are disposed so as to be spaced along the outer peripheral end 210 of the first flat plate 21.

The plurality of connection members 23 each include a first connection portion 231, a second connection portion 232, and third connection portions 233. The first connection portion 231 has a shape extending in a radial direction. The radial direction is a direction outward from the outer peripheral end 210 of the first flat plate 21. The second connection portion 232 has a circular arc shape extending along the outer peripheral end 210 of the first flat plate 21 in plan view (when viewed in a direction orthogonal to the main surface 201 and the main surface 202). The third connection portion 233 has a shape extending in a radial direction.

One end of the direction in which the first connection portion 231 extends is connected to the outer peripheral end 210 of the first flat plate 21. The other end of the direction in which the first connection portion 231 extends is connected to substantially the center in the direction in which the second connection portion 232 extends. Both ends of the direction in which the second connection portion 232 extends are connected to the frame 22 via the respective third connection portions 233.

With this configuration, the plurality of connection members 23 connect the first flat plate 21 and the frame 22 with openings 241 and openings 242 interposed therebetween. The openings 241 are each formed so as to include a region closer to the first flat plate 21 than the second connection portion 232. The openings 242 are regions closer to the frame 22 than the second connection portion 232. Each of the openings 241 and the openings 242 corresponds to a "first opening" of the present disclosure.

Then, with this configuration, the first flat plate 21 is supported in a state of being capable of performing bending vibration relative to the frame 22 via the plurality of connection members 23.

For example, the driver 30 is a piezoelectric element and is attached to the first flat plate 21. More specifically, the driver 30 is attached to the central portion of the first flat plate 21.

The plate member 40 has a main surface 401 and a main surface 402. The plate member 40 has a recessed portion recessed from the main surface 401. The bottom of the recessed portion has a plurality of through holes 400. The plurality of through holes 400 are disposed in a circular shape in plan view (when viewed in a direction orthogonal to the main surface 401 and the main surface 402). The diameter of the circle in which the plurality of through holes 400 are disposed is smaller than the diameter of the first flat plate 21. The plate member 40 corresponds to a "second flat plate" of the present disclosure.

The plate member 40 is disposed so as to be spaced from the plate member 20 such that the main surface 401 faces the main surface 201. In this case, the plate member 40 is disposed such that the plurality of through holes 400 overlap the first flat plate 21.

The side wall member 50 has a hollow 500 and has a loop shape. The side wall member 50 is disposed between the plate member 20 and the plate member 40. The side wall member 50 is connected to the frame 22 and the plate member 40.

Thus, the hollow chamber surrounded by the plate member 20, the side wall member 50, and the plate member 40 is formed and functions as a pump chamber 100. The pump chamber 100 communicates, through the plurality of through holes 400, with a space outside the fluid control device 10 closer to the plate member 40. In addition, the pump chamber 100 communicates, through the plurality of openings 241 and 242, with a space outside the fluid control device 10 closer to the plate member 20.

The valve member 60 includes a valve membrane 61 and a fixing layer 62. The valve membrane 61 and the fixing layer 62 each have a circular shape. That is, the external shape of the valve membrane 61 and the external shape of the fixing layer 62 are similar to the external shape (outer peripheral shape) of the first flat plate 21 and the shape formed by connecting the plurality of second connection portions 232 of the connection members 23. The external shape of the valve membrane 61 and the external shape of the fixing layer 62 are larger than the external shape of the first flat plate 21.

The valve membrane 61 bends more easily than the fixing layer 62. The fixing layer 62 bends more easily than the first flat plate 21. The relationship of the easiness of bending between these components is controlled by each material for the valve membrane 61, the fixing layer 62, and the first flat plate 21 and each thickness of the valve membrane 61, the fixing layer 62, and the first flat plate 21. For example, the first flat plate 21 is made of a metal. The fixing layer 62 has a bending modulus higher than that of the valve membrane 61. In addition, the fixing layer 62 is thicker than the valve membrane 61.

The valve membrane 61 is fixed to the main surface 201 of the first flat plate 21 with the fixing layer 62. In this case, the center of the valve membrane 61, the center of the fixing layer 62, and the center of the first flat plate 21 substantially coincide with each other. In this case, since the external shape of the valve membrane 61 and the external shape of the fixing layer 62 are larger than the external shape of the first flat plate 21, the valve member 60 formed by the external shape of the valve membrane 61 and the external shape of the fixing layer 62 has a projection projecting toward the outside of the outer peripheral end of the first flat plate 21.

The diameter of the valve membrane 61 is larger than the diameter of the fixing layer 62. Thus, a circular-shaped region of the valve membrane 61 closer to the center is fixed, and a ring-shaped region of the valve membrane 61 closer to an outer end 610 is not fixed. In other words, in a state in which the outer end 610 is not fixed, the valve membrane 61 is fixed to the first flat plate 21 with the fixing layer 62. A portion formed by only the valve membrane 61 corresponds to a "first portion of the valve member" of the present disclosure. A portion formed by laminating the valve membrane 61 and the fixing layer 62 corresponds to a "second portion of the valve member" of the present disclosure. A portion where the fixing layer 62 and the first flat plate 21 are in contact with each other corresponds to a "fixed portion" of the present disclosure.

The diameter of the fixing layer 62 is larger than the diameter of the first flat plate 21. Thus, as illustrated in FIGS. 2 and 3, an outer end 620 of the fixing layer 62 is located outside the outer peripheral end 210 of the first flat plate 21. In other words, in plan view, the outer end 620 of the fixing layer 62 overlaps the openings 241. In still other words, when the valve member is viewed in plan view, the portion (boundary portion) where the first portion of the valve member and the second portion of the valve member are connected does not overlap the first flat plate 21, is located outside the outer peripheral end 210 of the first flat plate 21, and overlaps the openings 241.

Figure 4A:
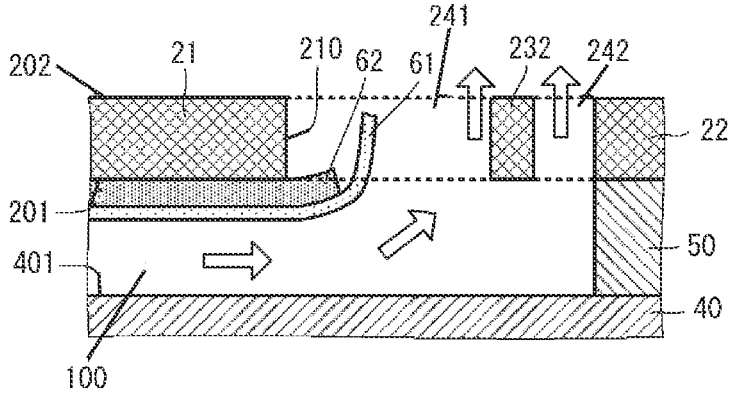
FIG. 4A is an enlarged view illustrating a fluid flow and the behavior of a valve member in a first state.
Figure 4B:
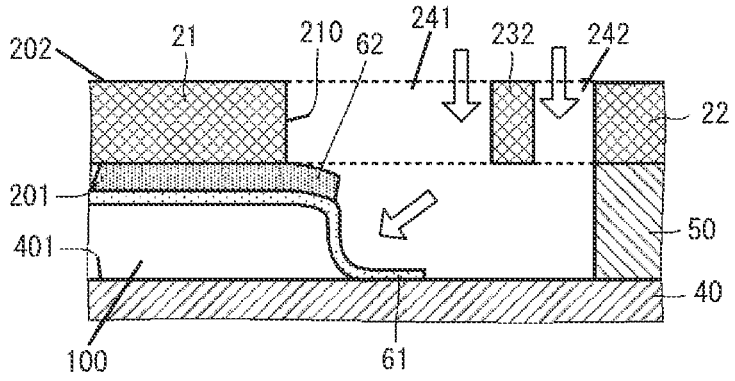
FIG. 4B is an enlarged view illustrating a fluid flow and the behavior of the valve member in a second state.

In this configuration, the fluid control device 10 rectifies a fluid flow as follows. FIG. 4A is an enlarged view illustrating a fluid flow and the behavior of the valve member in a first state. FIG. 4B is an enlarged view illustrating a fluid flow and the behavior of the valve member in a second state.

As illustrated in FIG. 4A, in the first state of the fluid control device 10, a fluid is suctioned from the outside closer to the plate member 40 into the pump chamber 100 via the plurality of through holes 400. The fluid flows in the pump chamber 100 in a direction from the central portion of the first flat plate 21 toward the outer peripheral end 210 (toward the side wall member 50).

A portion of the valve membrane 61 closer to the center thereof is fixed, and the outer end 610 of the valve membrane 61 is not fixed. Thus, the valve membrane 61 is bent by the fluid toward the first flat plate 21, in other words, toward the openings 241 and the connection members 23. As a result of this, the fluid flows from the pump chamber 100 into the openings 241 and is discharged from the openings 241 to the outside closer to the plate member 20. The fluid is also discharged from the openings 242 to the outside closer to the plate member 20.

As illustrated in FIG. 4B, in the second state of the fluid control device 10, a fluid is suctioned from the outside closer to the plate member 20 into the pump chamber 100 via the openings 241 and the openings 242. The fluid tries to flow in the pump chamber 100 in a direction from the outer peripheral end 210 of the first flat plate 21 (side wall member 50) toward the central portion of the first flat plate 21.

In this case, the valve membrane 61 is bent by the fluid toward the plate member 40. Then, a portion of the valve membrane 61 that has a predetermined area and that is closer to the outer end 610 comes into contact with the main surface 401 of the plate member 40. This obstructs the fluid flow toward the center of the pump chamber 100. Thus, the fluid does not reach the plurality of through holes 400 and is inhibited from being discharged to the outside closer to the plate member 40.

In this manner, the fluid control device 10 has a rectifying function of causing a fluid to flow in one direction.

The fluid control device 10 further has the following feature. The fluid control device 10 has the above configuration. Thus, a thickness D602 of the valve member 60 at a position overlapping the outer peripheral end 210 of the first flat plate 21 is larger than a thickness D601 of the outer end 610 (D602>D601).

As illustrated in FIG. 4A, in this configuration, when the valve membrane 61 bends toward the first flat plate 21, the portion that comes into contact with a corner of the outer peripheral end 210 of the first flat plate 21 is a portion having the thickness D602. That is, a portion thicker than the portion that is formed by only the valve membrane 61 and that includes the outer end 610 comes into contact with the corner of the outer peripheral end 210 of the first flat plate 21.

Thus, the portion of the valve member 60 that comes into contact with the corner of the outer peripheral end 210 of the first flat plate 21 is harder than and less prone to being worn than the outer end 610. This enables the fluid control device 10 to inhibit the valve member 60 from being worn and damaged.

In this configuration, the portion of the valve member 60 formed by laminating the valve membrane 61 and the fixing layer 62 is less prone to bending. The portion of the valve member 60 formed by laminating the valve membrane 61 and the fixing layer 62 is less prone to bending but bends more easily than the first flat plate 21. Thus, the deterioration of the rectifying function can be inhibited by appropriately setting the length of the portion of the fixing layer 62 projecting from the outer peripheral end 210 of the first flat plate 21 and the length of the portion of the valve membrane 61 projecting from the outer end 620 of the fixing layer 62 to form the valve member 60. That is, the fluid control device 10 is excellent in reliability by inhibiting the wear and damage and is capable of achieving a good rectifying function.

Then, in this configuration, the bending stress applied to the valve membrane 61 is dispersed by bending the fixing layer 62. Thus, it is possible to inhibit, at the outer end 620 of the fixing layer 62, the separation of the fixing layer 62 and the valve membrane 61 and the occurrence of the cracks in the valve membrane 61.

In addition, a configuration in which the fixing layer 62 is thicker than the valve membrane 61 has been described in the present embodiment, but the configuration is not limited thereto. It is sufficient that the portion of the valve member 60 that comes into contact with the corner of the outer peripheral end 210 of the first flat plate 21 be thicker than the portion of the valve member 60 that includes the outer peripheral end and that mainly achieves the rectifying function.

Furthermore, in other words, it is sufficient that the portion of the valve member 60 that comes into contact with the corner of the outer peripheral end 210 of the first flat plate 21 bend more easily than the first flat plate 21 and that the portion of the valve member 60 that includes the outer peripheral end and that mainly achieves the rectifying function bend more easily than the portion of the valve member 60 that comes into contact with the corner of the outer peripheral end 210 of the first flat plate 21.

In addition, a configuration in which the fixing layer 62 projects from the outer peripheral end 210 of the first flat plate 21 has been described. However, the outer end 620 of the fixing layer 62 and the outer peripheral end 210 of the first flat plate 21 may coincide with each other. However, even when the position where the fixing layer 62 is set on the first flat plate 21 varies, the fixing layer 62 projecting from the outer peripheral end 210 of the first flat plate 21 is capable of inhibiting the outer end 620 of the fixing layer 62 from being located closer to the center than the outer peripheral end 210 of the first flat plate 21.

In addition, in this configuration, the shape of the outer peripheral end 210 of the first flat plate 21, the shape of the outer end 620 of the fixing layer 62, and the shape of the outer end 610 of the valve membrane 61 are similar circular shapes. In addition, the plurality of through holes 400 are disposed in a circular shape. As a result of this, a fluid flows substantially evenly in all directions in plan view, thus improving the efficiency of the fluid control device 10.

Embodiment 2

Figure 5:
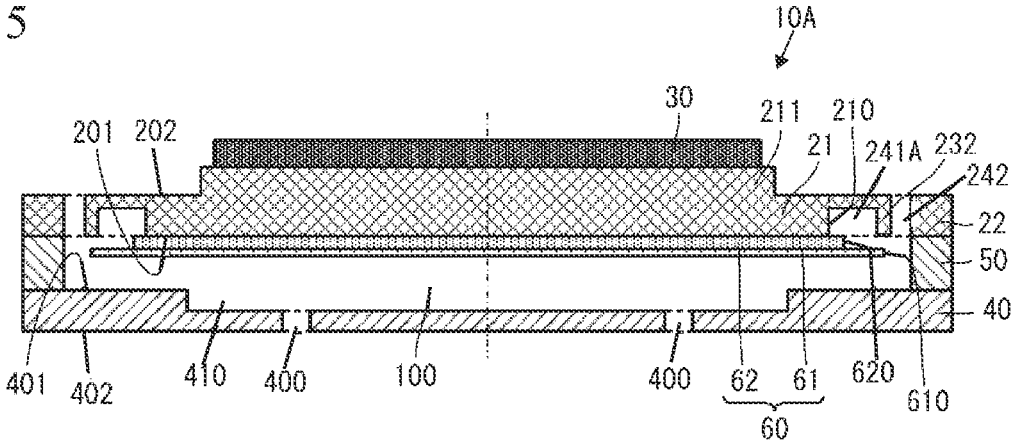
FIG. 5 is a side sectional view illustrating the configuration of a fluid control device according to Embodiment 2.

A fluid control device according to Embodiment 2 of the present disclosure will be described with reference to the drawing. FIG. 5 is a side sectional view illustrating the configuration of the fluid control device according to Embodiment 2.

As illustrated in FIG. 5, a fluid control device 10A according to Embodiment 2 differs from the fluid control device 10 according to Embodiment 1 in that the fluid control device 10A has recessed portions 241A instead of the openings 241. The other configurations of the fluid control device 10A are similar to those of the fluid control device 10, and descriptions of similar parts are omitted.

The recessed portion 241A is disposed between the first flat plate 21 and the second connection portion 232 of the connection member 23. The recessed portion 241A has a shape recessed from the main surface 201 of the plate member 20. In other words, the recessed portion 241A has a shape formed by closing an opening portion, opposite to the valve member 60, of the opening 241 according to Embodiment 1.

As with the fluid control device 10, this configuration enables the fluid control device 10A to inhibit the valve member 60 from being worn and damaged.

Embodiment 3

Figure 6A:
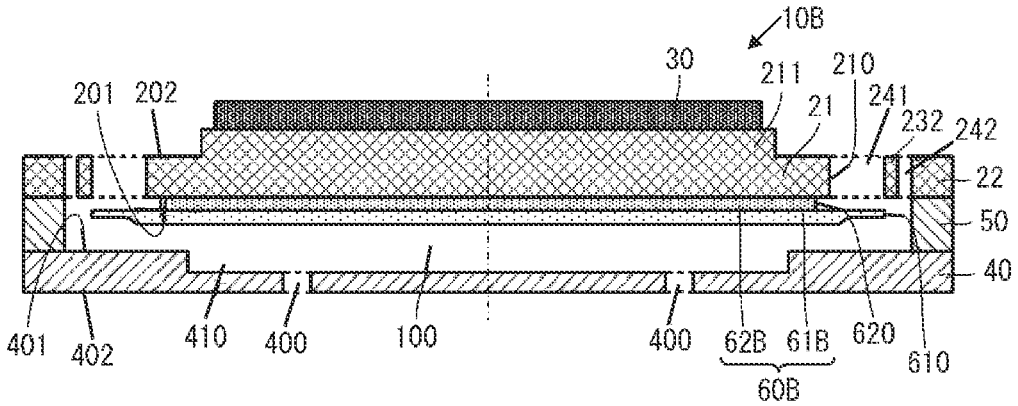
FIG. 6A is a side sectional view illustrating the configuration of a fluid control device according to Embodiment 3.
Figure 6B:
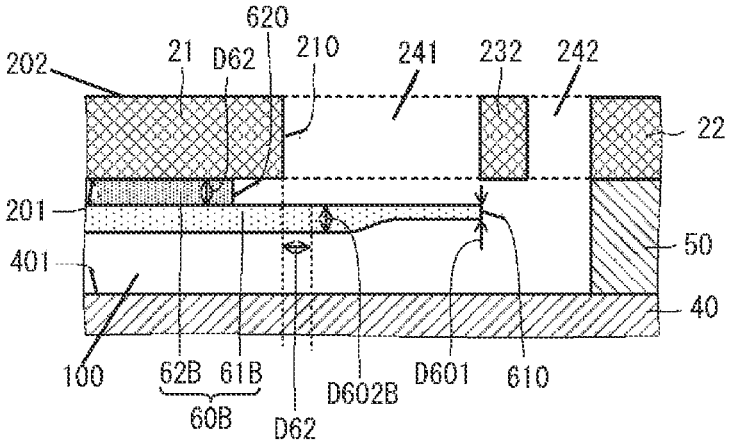
FIG. 6B is an enlarged view of a region including an outer peripheral end of a first flat plate of this fluid control device.

A fluid control device according to Embodiment 3 of the present disclosure will be described with reference to the drawings. FIG. 6A is a side sectional view illustrating the configuration of the fluid control device according to Embodiment 3. FIG. 6B is an enlarged view of a region including an outer peripheral end of a first flat plate of this fluid control device.

As illustrated in FIGS. 6A and 6B, a fluid control device 10B according to Embodiment 3 differs from the fluid control device 10 according to Embodiment 1 in the configuration of a valve member 60B. The other configurations of the fluid control device 10B are similar to those of the fluid control device 10, and descriptions of similar parts are omitted.

The valve member 60B includes a valve membrane 61B and a fixing layer 62B. The valve membrane 61B is fixed to the main surface 201 of the first flat plate 21 with the fixing layer 62B.

The external shape of the fixing layer 62B is smaller than the external shape of the first flat plate 21. More specifically, the diameter of the fixing layer 62B is smaller than the diameter of the first flat plate 21.

The valve membrane 61B includes a first portion including the outer end 610, and a second portion located closer to the center thereof than the first portion. A thickness D602B of the second portion is larger than the thickness D601 of the first portion.

The portion where the second portion and the first portion are connected (portion whose thickness varies) is located outside the outer peripheral end 210 of the first flat plate 21.

In this configuration, even when the outer end 620 of the fixing layer 62B is located closer to the center than the outer peripheral end 210 of the first flat plate 21, the portion of the valve membrane 61B overlapping the outer peripheral end 210 of the first flat plate 21 is the second portion, that is, a thick portion of the valve membrane 61B.

Thus, even when the valve membrane 61B bends toward the outer peripheral end 210 of the first flat plate 21 and comes into contact with the corner of the outer peripheral end 210, it is possible to inhibit the valve membrane 61B from being worn and damaged. In this case, as illustrated in FIG. 6B, the position of the outer end of the second portion is preferably located outside the outer peripheral end 210 of the first flat plate 21 so as to be away therefrom substantially by a thickness D62 of the fixing layer 62B. As a result of this, when the valve membrane 61B comes into contact with the corner of the outer peripheral end 210, the second portion more reliably comes into contact with the corner of the outer peripheral end 210. Thus, it is possible to more reliably inhibit the valve membrane 61B from being worn and damaged.

Embodiment 4

Figure 7:
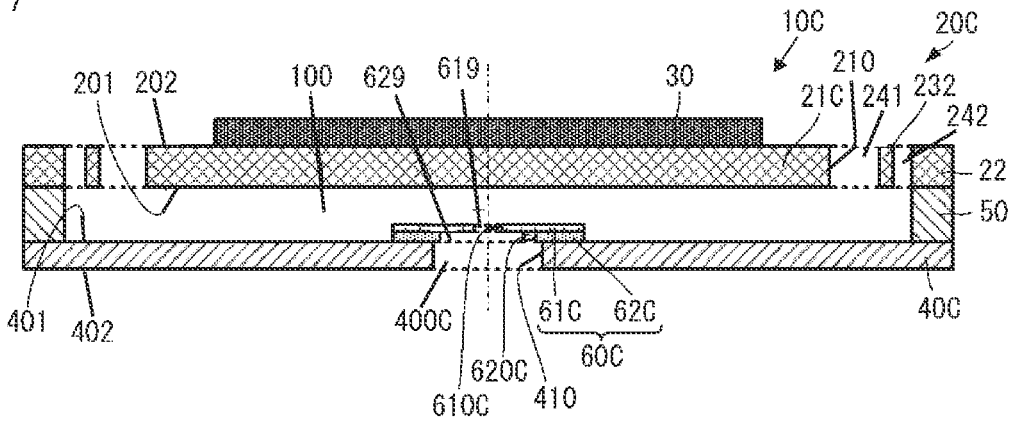
FIG. 7 is a side sectional view illustrating the configuration of a fluid control device according to Embodiment 4.

A fluid control device according to Embodiment 4 of the present disclosure will be described with reference to the drawing. FIG. 7 is a side sectional view illustrating the configuration of the fluid control device according to Embodiment 4.

As illustrated in FIG. 7, a fluid control device 10C according to Embodiment 4 differs from the fluid control device 10 according to Embodiment 1 mainly in the shape and the disposition of a valve member 60C. In addition, the fluid control device 10C differs from the fluid control device 10 in the shape of each of a plate member 20C and a plate member 40C. The other configurations of the fluid control device 10C are similar to those of the fluid control device 10, and descriptions of similar parts are omitted.

The fluid control device 10C includes the plate member 20C, the plate member 40C, and the valve member 60C. The plate member 20C includes a first flat plate 21C. The first flat plate 21C has a uniform thickness.

The plate member 40C has a uniform thickness. A through hole 400C is formed at the center when the plate member 40C is viewed in plan view. The through hole 400C passes through the plate member 40C in the thickness direction (direction orthogonal to the main surface 401 and the main surface 402). For example, the through hole 400C has a cylindrical shape.

The valve member 60C includes a valve membrane 61C and a fixing layer 62C.

The valve membrane 61C has a ring shape and has an opening 619, which has a circular shape. The outer diameter (diameter) of the valve membrane 61C is larger than the diameter of the through hole 400C. The diameter of the opening 619 is smaller than the diameter of the through hole 400C.

The outer diameter (diameter) of the fixing layer 62C is larger than the diameter of the through hole 400C. The diameter of an opening 629 is smaller than the diameter of the through hole 400C and larger than the diameter of the opening 619 of the valve membrane 61C.

The valve membrane 61C is fixed to the main surface 401, which is a main surface of the plate member 40C closer to the pump chamber, via the fixing layer 62C. In this case, the center of the opening 619 of the valve membrane 61C, the center of the opening 629 of the fixing layer 62C, and the center of the through hole 400C substantially coincide with each other in plan view.

With this configuration, a region of the valve membrane 61C closer to the outer end thereof is fixed to the main surface 401 via the fixing layer 62C. Thus, in the case of the fluid control device 10C, when a fluid is suctioned from the openings 241 and the openings 242, the valve member 60C bends so as to enter the through hole 400C. Then, the fluid is discharged from the through hole 400C to the outside. On the other hand, when a fluid is suctioned from the through hole 400C, the valve member 60C bends toward the plate member 20C, and a region of the valve membrane 61C closer to an inner end 610C comes into contact with the main surface 201 of the plate member 20C. Thus, the fluid does not flow in directions toward the outer peripheral end 210 of the plate member 20C.

In this manner, the fluid control device 10C has a rectifying function of causing a fluid to flow in one direction.

In the case of the fluid control device 10C, in plan view, the inner end 610C of the valve membrane 61C and an inner end 620C of the fixing layer 62C are located further inside (closer to the center) of the through hole 400C than a wall 410 of the through hole 400C. In addition, the inner end 610C of the valve membrane 61C is located inside the inner end 620C of the fixing layer 62C.

Thus, even when the valve member 60C bends toward the through hole 400C, the fixing layer 62C comes into contact with the corner of the wall 410 of the through hole 400C closer to the pump chamber 100, and the valve membrane 61C does not come into contact with the corner of the wall 410. This enables the fluid control device 10C to inhibit the valve membrane 61C from being worn and damaged.

Embodiment 5

Figure 8A:
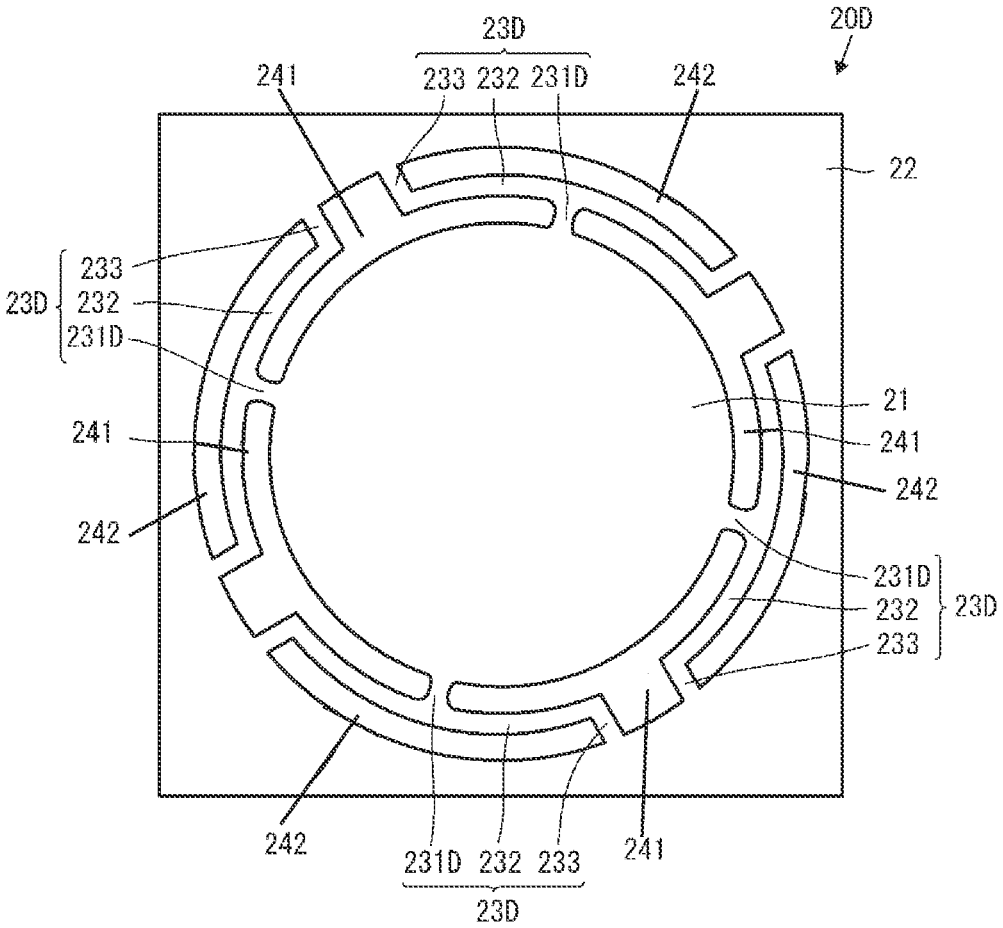
FIG. 8A is a plan view of a plate member of a fluid control device according to Embodiment 5, a driver being configured to be attached to the plate member.
Figure 8B:
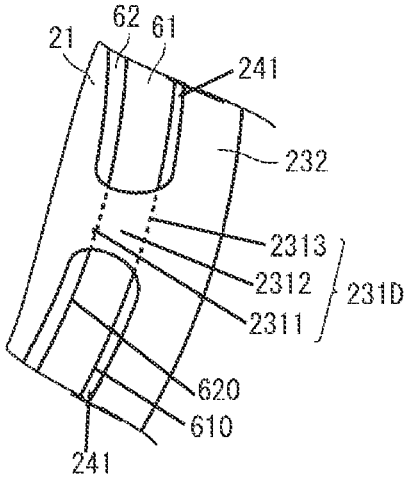
FIG. 8B is an enlarged plan view of a part where one connection member of this fluid control device is located.

A fluid control device according to Embodiment 5 of the present disclosure will be described with reference to the drawings. FIG. 8A is a plan view of a plate member of the fluid control device according to Embodiment 5, a driver being configured to be attached to the plate member. FIG. 8B is an enlarged plan view of a part where one connection member of this fluid control device is located.

As illustrated in FIGS. 8A and 8B, the fluid control device according to Embodiment 5 differs from the fluid control device 10 according to Embodiment 1 in the shape of connection members 23D of a plate member 20D. The other configurations of the fluid control device according to Embodiment 5 are similar to those of the fluid control device 10, and descriptions of similar parts are omitted.

As illustrated in FIGS. 8A and 8B, the connection members 23D each include a first connection portion 231D, the second connection portion 232, and the third connection portions 233. The first connection portion 231D has an inner end portion 2311, a joint portion 2312, and an outer end portion 2313. The inner end portion 2311 is connected to the outer peripheral end 210 of the first flat plate 21. The outer end portion 2313 is connected to the second connection portion 232. The joint portion 2312 is connected to the inner end portion 2311 and the outer end portion 2313.

The joint portion 2312 has a shape that becomes wider from the end thereof closer to the inner end portion 2311 toward the end thereof closer to the outer end portion 2313.

As illustrated in FIG. 8B, this configuration enables an increase in the area of the part of the joint portion 2312 with which the outer end 610 of the valve membrane 61 comes into contact. Thus, even when the valve membrane 61 comes into contact with the joint portion 2312, it is possible to inhibit the valve membrane 61 from being worn and damaged.

The inner end portion 2311 has no corners in the portion where the inner end portion 2311 and the first flat plate 21 are connected. The inner end portion 2311 has a shape that becomes gradually narrower toward the joint portion 2312. In addition, the inner end portion 2311 is connected to the joint portion 2312 without corners.

The outer end portion 2313 has no corners in the portion where the outer end portion 2313 and the second connection portion 232 are connected. The outer end portion 2313 has a shape that becomes gradually narrower toward the joint portion 2312. In addition, the outer end portion 2313 is connected to the joint portion 2312 without corners.

With these configurations, the outer end 620 of the fixing layer 62 and the outer end 610 of the valve membrane 61 do not come into contact with corners. Thus, it is possible to further inhibit the valve membrane 61 and the fixing layer 62 from being worn and damaged.

Embodiment 6

Figure 9:
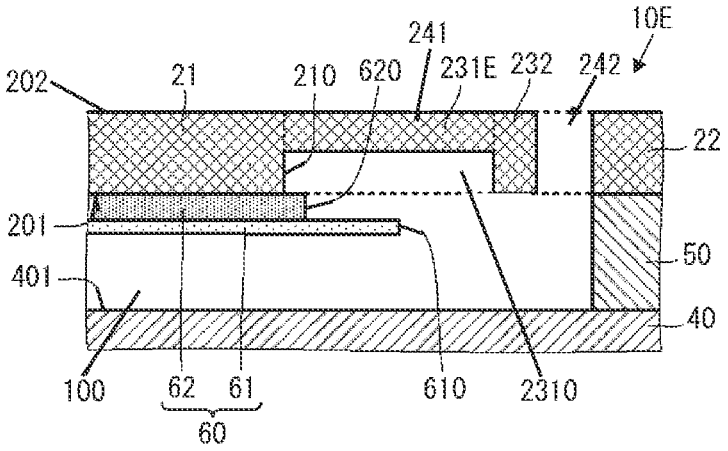
FIG. 9 is an enlarged view of a region including an outer peripheral end of a first flat plate and a connection member of a fluid control device according to Embodiment 6.
Figure 10A:
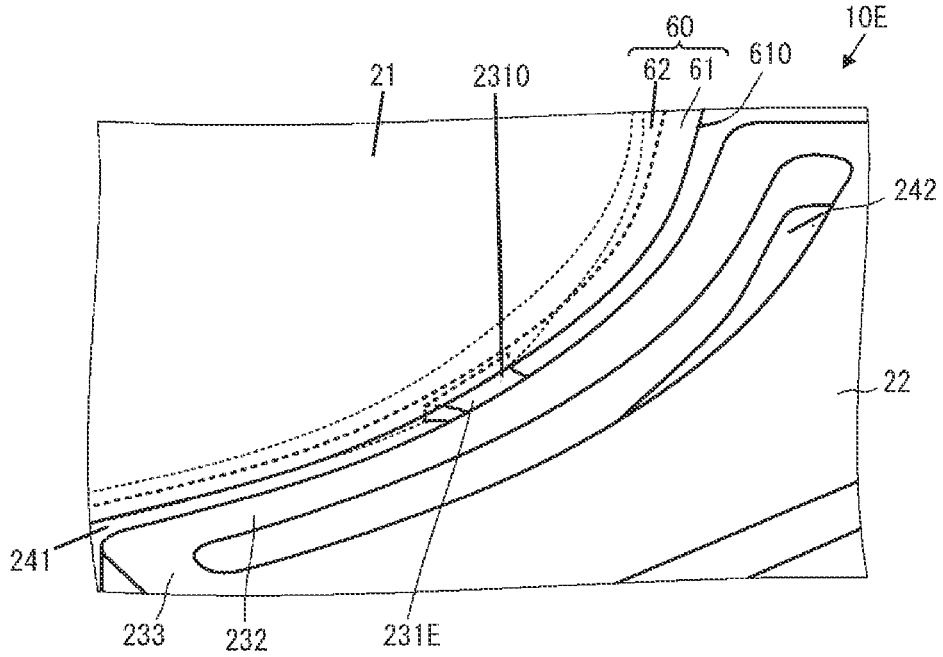
FIGS. 10A and 10B are enlarged perspective views of a region including the outer peripheral end of the first flat plate and the connection member of the fluid control device according to Embodiment 6.
Figure 10B:
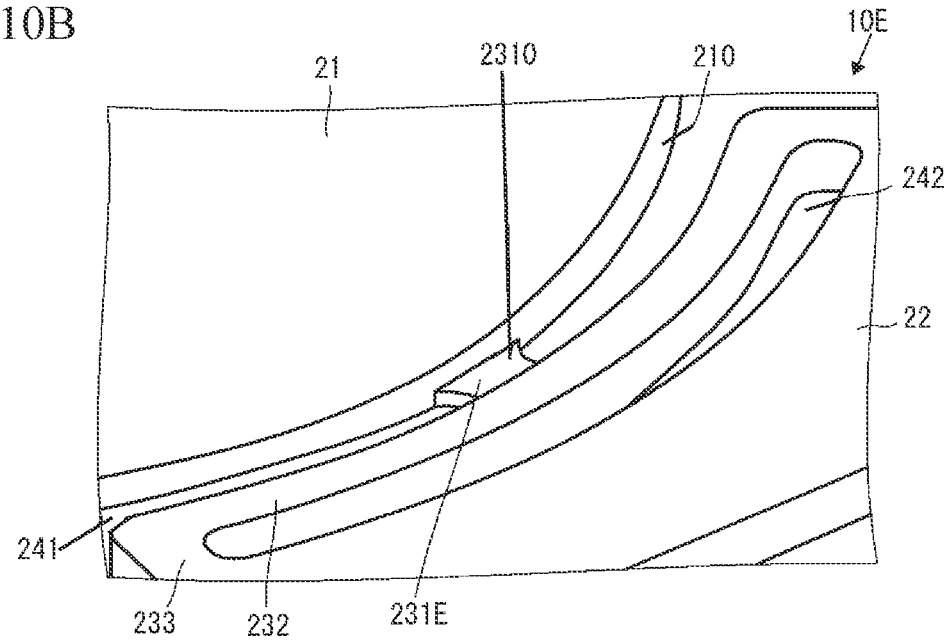

A fluid control device according to Embodiment 6 of the present disclosure will be described with reference to the drawings. FIG. 9 is an enlarged view of a region including an outer peripheral end of a first flat plate and a connection member of the fluid control device according to Embodiment 6. FIGS. 10A and 10B are enlarged perspective views of a region including the outer peripheral end of the first flat plate and the connection member of the fluid control device according to Embodiment 6. FIG. 10A illustrates a state in which a valve membrane is disposed. FIG. 10B illustrates a state in which the valve membrane is detached.

As illustrated in FIGS. 9, 10A, and 10B, a fluid control device 10E according to Embodiment 6 differs from the fluid control device 10 according to Embodiment 1 in the shape of a first connection portion 231E of a connection member. The other configurations of the fluid control device 10E are similar to those of the fluid control device 10, and descriptions of similar parts are omitted.

The first connection portion 231E has a recessed portion 2310, which is recessed from the main surface 201 of the first flat plate 21 relative to the first flat plate 21 and the second connection portion 232. In other words, the first connection portion 231E has the recessed portion 2310, which is recessed from the surface of the first flat plate 21 where the valve member 60 is disposed and which is located in a portion overlapping the outer end 610 of the valve member 60 and the first portion (portion formed by only the valve membrane 61) of the valve member 60 when the valve member 60 is viewed in plan view.

With this configuration, the first portion of the valve member 60 is less prone to coming into contact with the first connection portion 231E. This enables the fluid control device 10E to further inhibit the valve membrane 61 from being worn and damaged.

Embodiment 7

Figure 11:
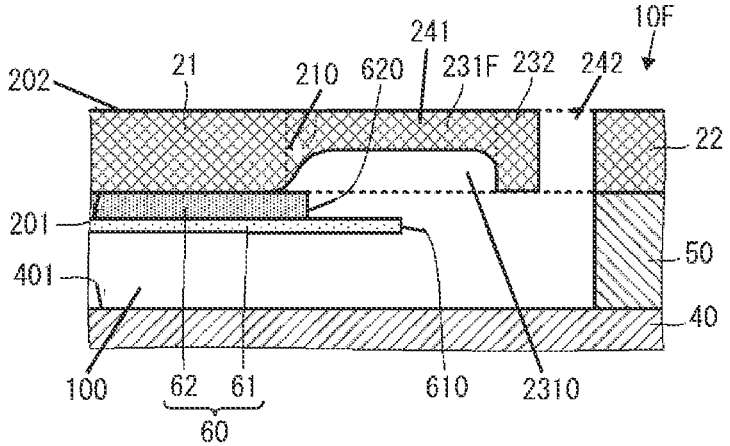
FIG. 11 is an enlarged view of a region including an outer peripheral end of a first flat plate and a connection member of a fluid control device according to Embodiment 7.

A fluid control device according to Embodiment 7 of the present disclosure will be described with reference to the drawing. FIG. 11 is an enlarged view of a region including an outer peripheral end of a first flat plate and connection members of the fluid control device according to Embodiment 7.

As illustrated in FIG. 11, a fluid control device 10F according to Embodiment 7 differs from the fluid control device 10E according to Embodiment 6 in the shape of a first connection portion 231F of a connection member. The other configurations of the fluid control device 10F are similar to those of the fluid control device 10E, and descriptions of similar parts are omitted.

The first connection portion 231F has a curved surface in an opening portion of the recessed portion 2310 closer to the first flat plate 21. In other words, the recessed portion 2310 has a shape that becomes gradually deeper from the end of the recessed portion 2310 closer to the first flat plate 21 toward the center of the recessed portion 2310.

With this configuration, even when the valve member 60 bends toward the first connection portion 231F and the first flat plate 21, the valve member 60 does not come into contact with a sharp corner. This enables the fluid control device 10F to further inhibit the valve membrane 61 from being worn and damaged.

Embodiment 8

Figure 12:
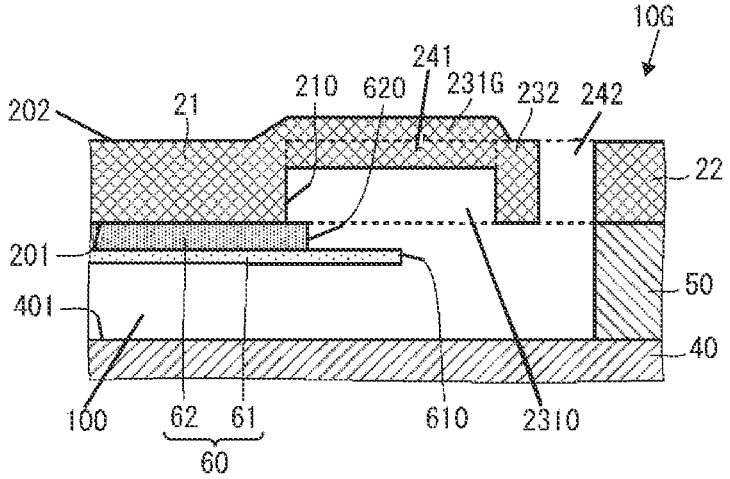
FIG. 12 is an enlarged view of a region including an outer peripheral end of a first flat plate and a connection member of a fluid control device according to Embodiment 8.

A fluid control device according to Embodiment 8 of the present disclosure will be described with reference to the drawing. FIG. 12 is an enlarged view of a region including an outer peripheral end of a first flat plate and a connection member of the fluid control device according to Embodiment 8.

As illustrated in FIG. 12, a fluid control device 10G according to Embodiment 8 differs from the fluid control device 10E according to Embodiment 6 in the shape of a first connection portion 231G of a connection member. The other configurations of the fluid control device 10G are similar to those of the fluid control device 10E, and descriptions of similar parts are omitted.

The first connection portion 231G bends in the middle in the direction connecting the first flat plate 21 and the second connection portion 232 so as to project from the main surface 202 of the first flat plate 21.

This configuration facilitates provision of the first connection portion 231G having a predetermined thickness and having the recessed portion 2310. Thus, the first connection portion 231G is capable of having a predetermined strength. This enables the fluid control device 10G to further inhibit the valve membrane 61 from being worn and damaged and to inhibit a reduction in reliability.

Embodiment 9

Figure 13:
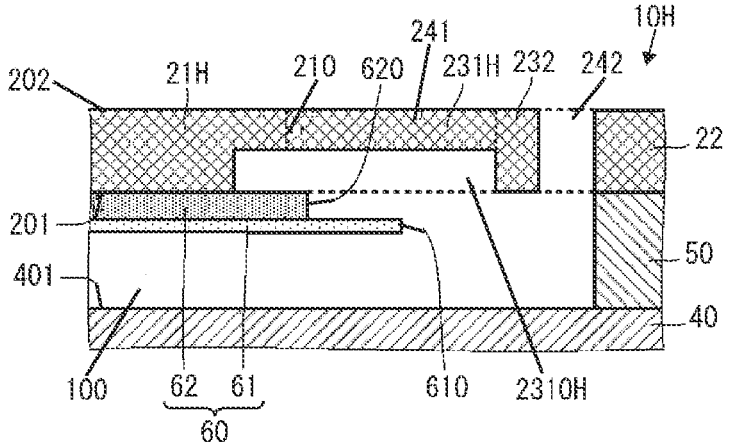
FIG. 13 is an enlarged view of a region including an outer peripheral end of a first flat plate and a connection member of a fluid control device according to Embodiment 9.

A fluid control device according to Embodiment 9 of the present disclosure will be described with reference to the drawing. FIG. 13 is an enlarged view of a region including an outer peripheral end of a first flat plate and a connection member of the fluid control device according to Embodiment 9.

As illustrated in FIG. 13, a fluid control device 10H according to Embodiment 9 differs from the fluid control device 10E according to Embodiment 6 in the shape of each of a first flat plate 21H and a recessed portion 2310H. The other configurations of the fluid control device 10H are similar to those of the fluid control device 10E, and descriptions of similar parts are omitted. The shape of a first connection portion 231H of the fluid control device 10H is similar to that of the first connection portion 231E of the fluid control device 10E, and a description thereof is omitted.

The first flat plate 21H has a recessed portion recessed from the main surface 201 at the outer peripheral end 210. This recessed portion of the first flat plate 21H communicates with a recessed portion of the first connection portion 231H, thus forming the recessed portion 2310H. In other words, the recessed portion 2310H extends from the first connection portion 231H to the inside of the outer peripheral end 210 of the first flat plate 21H.

This configuration enables the fluid control device 10H to further inhibit the valve membrane 61 from being worn and damaged.

Embodiment 10

Figure 14:
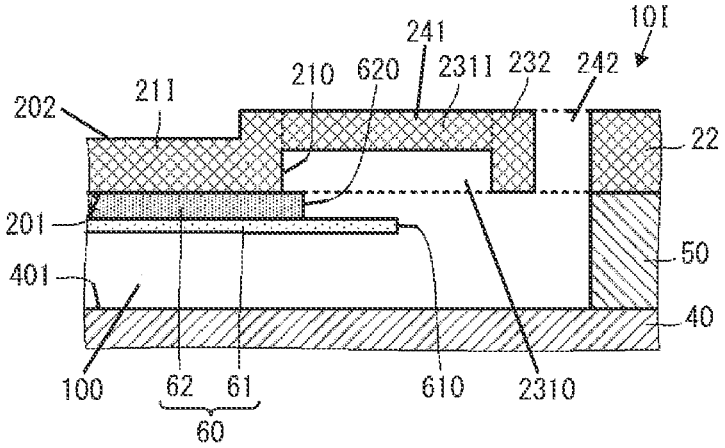
FIG. 14 is an enlarged view of a region including an outer peripheral end of a first flat plate and a connection member of a fluid control device according to Embodiment 10.

A fluid control device according to Embodiment 10 of the present disclosure will be described with reference to the drawing. FIG. 14 is an enlarged view of a region including an outer peripheral end of a first flat plate and a connection member of the fluid control device according to Embodiment 10.

As illustrated in FIG. 14, a fluid control device 10I according to Embodiment 10 differs from the fluid control device 10E according to Embodiment 6 in the configuration in which a first flat plate 21I and the connection member are connected. The other configurations of the fluid control device 10I are similar to those of the fluid control device 10E, and descriptions of similar parts are omitted.

A first connection portion 231I is connected to the main surface 202 in the vicinity of the outer peripheral end 210 of the first flat plate 21I. With this configuration, the depth of the recessed portion 2310 is equal to or larger than the thickness of the first flat plate 21I.

This configuration enables the fluid control device 10I to further inhibit the valve membrane 61 from being worn and damaged.

Examples of a first flat plate having a circular shape and a valve member having a circular shape or a ring shape have been described in the above embodiments. However, these components may have polygonal shapes, preferably regular polygonal shapes having a large number of angles. However, such a circular shape enables a fluid control device to improve in efficiency.

In addition, configurations in which the shape of a first flat plate and the shape of a valve membrane are similar to each other have been described in the above embodiments. However, for example, the combination of the shapes of these components may be a combination of a circular shape and a regular polygonal shape. However, such similar shapes enable a fluid control device to improve in efficiency.

Furthermore, the shape of a valve membrane and the shape formed by second connection portions of connection members that are similar to each other improve the efficiency of a fluid passing through the opening 241, thus enabling a fluid control device to improve in efficiency.

In addition, a configuration in which a driver is set on a first flat plate has been described above. However, a configuration in which a driver is set on a plate member (second flat plate) may be used.

In addition, the configurations of the above embodiments can be combined as appropriate. It is possible to achieve functions and effects according to respective combinations.

10, 10A, 10B, 10C, 10E, 10F, 10G, 10H, 10I fluid control device
20, 20C, 20D plate member
21, 21C, 21H, 21I first flat plate
22 frame
23, 23D connection member
30 driver
40, 40C plate member
50 side wall member
60, 60B, 60C valve member
61, 61B, 61C valve membrane
62, 62B, 62C fixing layer
100 pump chamber
201, 202 main surface
210 outer peripheral end
231, 231D, 231E, 231F, 231G, 231H, 231I first connection portion
232 second connection portion
233 third connection portion
241, 242 opening
241A recessed portion
400, 400C through hole
401, 402 main surface
410 wall
500 hollow
610 outer end
610C inner end
619 opening
620 outer end
620C inner end
629 opening
2310, 2310H recessed portion
2311 inner end portion
2313 outer end portion

The invention claimed is:

1. A fluid control device comprising:
a first flat plate having a first surface and a second surface;
a frame disposed outside an outer peripheral end of the first flat plate;
a connection member connecting the first flat plate and the frame;
a first opening surrounded by the first flat plate, the frame, and the connection member;
a second flat plate having a second opening in a portion facing the first flat plate;
a side wall member connecting the frame and the second flat plate, the side wall member together with the first flat plate and the second flat plate forming a pump chamber;
a driver set on one of the first flat plate and the second flat plate; and
a valve member set on said first surface of the first flat plate, said first surface being closer to the pump chamber than said second surface, the valve member being configured to cause a fluid to flow in one direction, wherein
the valve member has
a fixed portion fixed to the first flat plate, and
a projection projecting laterally outward from said fixed portion and having an outer end projecting toward an outside of the outer peripheral end of the first flat plate when the valve member is viewed in plan view,
the projection has
a first portion having a first thickness, and
a second portion located between the first portion and the fixed portion, the second portion having a second thickness,
the second thickness is thicker than the first thickness, and
at least a part of the second portion overlaps the first opening when the first surface of the first flat plate is viewed in cross-section.

2. The fluid control device according to claim 1, wherein a portion where the second portion and the first portion are connected is located outside the outer peripheral end of the first flat plate.

3. The fluid control device according to claim 2, wherein
the connection member includes
a first connection portion connected to the outer peripheral end of the first flat plate, the first connection portion extending outward from the outer peripheral end of the first flat plate, and
a second connection portion connected to the first connection portion, the second connection portion being connected to the frame at a position different from a position where the first connection portion and the first flat plate are connected, and
the first connection portion has a recessed portion recessed from a side where the valve member is disposed and located in a portion overlapping the first portion when the valve member is viewed in plan view.

4. The fluid control device according to claim 2, wherein a shape of the outer end of the valve member is the same as a shape of the outer peripheral end of the first flat plate.

5. The fluid control device according to claim 2, wherein the valve member includes a valve membrane having flexibility, and a fixing layer configured to fix the valve membrane, the first portion is comprised of the valve membrane, and the second portion is comprised of a portion having the valve membrane and the fixing layer laminated.

6. The fluid control device according to claim 1, wherein the connection member includes a first connection portion connected to the outer peripheral end of the first flat plate, the first connection portion extending outward from the outer peripheral end of the first flat plate, and a second connection portion connected to the first connection portion, the second connection portion being connected to the frame at a position different from a position where the first connection portion and the first flat plate are connected, and the first connection portion has a recessed portion recessed from a side where the valve member is disposed and located in a portion overlapping the first portion when the valve member is viewed in plan view.

7. The fluid control device according to claim 6, wherein a shape of the outer end of the valve member is a shape extending along the second connection portion.

8. The fluid control device according to claim 7, wherein the first connection portion has a portion overlapping the second portion of the projection, and a portion overlapping the first portion of the projection, and a width of the portion overlapping the first portion is greater than a width of the portion overlapping the second portion.

9. The fluid control device according to claim 8, wherein a shape of the outer end of the valve member is the same as a shape of the outer peripheral end of the first flat plate.

10. The fluid control device according to claim 7, wherein a shape of the outer end of the valve member is the same as a shape of the outer peripheral end of the first flat plate.

11. The fluid control device according to claim 7, wherein the valve member includes a valve membrane having flexibility, and a fixing layer configured to fix the valve membrane, the first portion is comprised of the valve membrane, and the second portion is comprised of a portion having the valve membrane and the fixing layer laminated.

12. The fluid control device according to claim 6, wherein a shape of the outer end of the valve member is the same as a shape of the outer peripheral end of the first flat plate.

13. The fluid control device according to claim 6, wherein the valve member includes a valve membrane having flexibility, and a fixing layer configured to fix the valve membrane, the first portion is comprised of the valve membrane, and the second portion is comprised of a portion having the valve membrane and the fixing layer laminated.

14. The fluid control device according to claim 1, wherein a shape of the outer end of the valve member is the same as a shape of the outer peripheral end of the first flat plate.

15. The fluid control device according to claim 1, wherein the valve member includes a valve membrane having flexibility, and a fixing layer configured to fix the valve membrane, the first portion is comprised of the valve membrane, and the second portion is comprised of a portion having the valve membrane and the fixing layer laminated.

16. The fluid control device according to claim 15, wherein the fixing layer deforms more easily in a direction in which the first flat plate and the second flat plate face each other than the first flat plate or the second flat plate, and the valve membrane deforms more easily in the direction in which the first flat plate and the second flat plate face each other than the fixing layer.

17. The fluid control device according to claim 1, wherein the driver is set on the first flat plate and is configured to vibrate the first flat plate.

18. The fluid control device according to claim 1, wherein the driver is set on the second flat plate and is configured to vibrate the second flat plate.

* * * * *